US005506094A

United States Patent [19]

Merkel et al.

[11] Patent Number: 5,506,094

[45] Date of Patent: Apr. 9, 1996

[54] PHOTOGRAPHIC ELEMENTS COMPRISING 2-PHENYLCARBAMOYL-1-NAPHTHOL IMAGE-MODIFYING COUPLERS YIELDING DYES RESISTANT TO CRYSTALLIZATION AND REDUCTION

[75] Inventors: Paul B. Merkel; Jerrold N. Poslusny, both of Rochester; Melvin M. Kestner, Hilton; Ronald E. Leone, Rochester; David A. Steele, Webster, all of N.Y.

[73] Assignee: Eastman Kodak Company, Rochester, N.Y.

[21] Appl. No.: 98,552

[22] Filed: Jul. 28, 1993

[51] Int. Cl.[6] ..... G03C 7/305; G03C 7/34

[52] U.S. Cl. ..... 430/544; 430/553; 430/957

[58] Field of Search ..... 430/955, 956, 430/957, 958, 543, 544, 553, 561, 562, 563, 549

[56] References Cited

U.S. PATENT DOCUMENTS

| | | | |
|---|---|---|---|
| 3,459,552 | 1/1966 | Yoshida et al. | 96/100 |
| 3,488,193 | 1/1970 | Eynde et al. | 96/55 |
| 4,725,530 | 2/1988 | Kobayashi et al. | 430/505 |
| 4,818,664 | 4/1989 | Ueda et al. | 430/553 |
| 4,840,884 | 6/1989 | Mooberry et al. | 430/557 |
| 4,857,442 | 8/1989 | Fujita et al. | 430/553 |
| 4,883,746 | 11/1989 | Shimada et al. | 430/504 |
| 4,957,853 | 9/1990 | Kobayashi et al. | 430/384 |
| 5,085,979 | 2/1992 | Yamagami et al. | 430/957 |
| 5,114,835 | 5/1992 | Sakanoue | 430/393 |
| 5,250,405 | 10/1993 | Merkel et al. | 430/544 |

FOREIGN PATENT DOCUMENTS

| | | | |
|---|---|---|---|
| 676750 | 12/1963 | Canada | 96/102 |
| 0193389 | 10/1990 | European Pat. Off. | G03C 7/32 |
| 2454329 | 5/1975 | Germany | G03C 7/34 |
| 62-247363 | 10/1987 | Japan | G03C 7/34 |
| 4356040 | 12/1992 | Japan | 430/558 |
| 1111342 | 4/1968 | United Kingdom | G03C 7/34 |

*Primary Examiner*—Lee C. Wright
*Attorney, Agent, or Firm*—Peter C. Cody

[57] ABSTRACT

Photographic elements comprising certain 2-phenylcarbamoyl-1-naphthol image-modifying couplers exhibit proper hue, a resistance to dye crystallization, and a resistance to leuco cyan dye formation. Such couplers can be utilized for their image-modifying effect and can contribute substantially to the overall dye density of an image.

17 Claims, No Drawings

PHOTOGRAPHIC ELEMENTS COMPRISING 2-PHENYLCARBAMOYL-1-NAPHTHOL IMAGE-MODIFYING COUPLERS YIELDING DYES RESISTANT TO CRYSTALLIZATION AND REDUCTION

FIELD OF THE INVENTION

This invention relates to photographic elements and to novel two-equivalent 2-phenylcarbamoyl- 1-naphthol image-modifying couplers.

BACKGROUND

Modern photographic materials, particularly color negative films, contain a variety of so-called image modifying couplers including development inhibitor releasing (DIR) couplers, switched or timed inhibitor releasing (DIAR) couplers, bleach accelerator releasing couplers (BARCs) and colored masking couplers. DIR couplers, such as those described in U.S. Pat. No. 3,227,554, and DIAR couplers, such as those described in U.S. Pat. No. 4,248,962, perform such useful functions as gamma or curve shape control, sharpness enhancement, granularity reduction and color correction. BARCs, such as those described in European Patent Application 193,389, facilitate the oxidation of developed silver in bleach solutions. They may also enhance silver developability, thereby affecting gamma. Masking couplers, such as those described in J. Opt. Soc. Am, 40, 171 (1950) and in U.S. Pat. No. 2,428,054, are used to correct for the unwanted absorptions of various imaging dyes.

Modern color negative films often contain both image couplers, which contribute solely to the production of dye, and image-modifying couplers, such as those described above. The image-modifying couplers, in addition to having an image modifier component (e.g. bleach accelerator or development inhibitor), also comprise an image dye parent. In films which comprise both image couplers and image-modifying couplers, much of the ultimate color density exhibited by the film is often derived from the parent of the image-modifying coupler.

Many films today contain large amounts of such image-modifying couplers in the red-sensitive, cyan-dye-containing layers. These image-modifying couplers typically have cyan image dye parents which generate cyan dye upon reaction of the image-modifying couplers with oxidized developer. Because such cyan dye substantially contributes to the total red density in these films, it is important that the dyes generated from the image-modifying couplers have suitable properties. Desirable properties include good hue, good stability, resistance to reduction in seasoned bleaches or in bleaches of low oxidizing strength, and resistance to hue changes on storage at low temperatures.

Resistance to reduction in seasoned bleaches is particularly important because certain cyan dyes are prone to being reduced by ferrous ion complexes (such as ferrous EDTA) and other reducing agents, which are found in seasoned bleach solutions. When reduced, these cyan dyes form leuco cyan dyes (LCD formation). Leuco cyan dyes are colorless and, thus, films containing couplers which are easily converted into leuco cyan dyes exhibit substantial loss (and variability) in color density during processing.

Resistance to hue changes upon storage at low temperatures is also of particular importance. Certain cyan dyes tend to crystallize at low temperatures. This naturally affects the hue of such dyes, and it ultimately leads to inaccurate color and tone reproduction in films which have been stored at low temperatures, and which contain these dyes.

From the above, it can be seen that a need exists for image-modifying couplers which are capable of being used in conjunction with image couplers, and which can contribute substantially to the overall color density of an image. Furthermore, a need exists that the dyes generated from such image-modifying couplers be resistant to reduction in seasoned bleaches and be resistant to crystallization at low temperatures.

Certain of the above needs have been provided by known couplers having a 2-phenylcarbamoyl-1-naphthol structure. However, such couplers do not enable all of the above needs to be met. Image couplers, for instance, are known which yield dyes that are resistant to reduction in seasoned bleaches (U.S. Pat. No. 3,488,193 and U.S. Pat. No. 4,957,853). However, these couplers often crystallize at low temperatures. Furthermore, U.S. Pat. No. 4,957,853 discloses that these couplers should not be combined with photographically useful groups to form image-modifying couplers. Such a combination would impair the photographic properties of a photographic element containing the image-modifying couplers.

Bleach accelerator releasing couplers, development inhibitor releasing couplers (both timed and untimed, switched and unswitched), and masking couplers, having a 2-phenylcarbamoyl-1-naphthol structure, are also known (EP 0193389, Japanese Kokai JP62-247363, U.S. Pat. No. 4,725,530, DE 2,454,329, British Patent 1,111,342, Japanese Kokai JP62-087959, U.S. Pat. No. 3,459,552, and U.S. Pat. No. 4,883,746). Several of these image-modifying couplers, however, provide dyes which crystallize at low temperatures. Several others provide dyes which are prone to reduction in seasoned bleach, or which exhibit improper hue; and still others have insufficient or improper image-modifying effect.

As noted, a need exists to provide for image-modifying couplers which are capable of being used in conjunction with image couplers, and which can contribute substantially to the overall color density of an image. Furthermore, a need exists that such image-modifying couplers be resistant to reduction in seasoned bleaches and be resistant to crystallization at low temperatures.

SUMMARY OF THE INVENTION

In this regard, the present invention solves these problems by providing a photographic element comprising a support bearing (a) at least one silver halide emulsion and (b) at least one cyan dye-forming 2-phenylcarbamoyl-1-naphthol image-modifying coupler having the structure

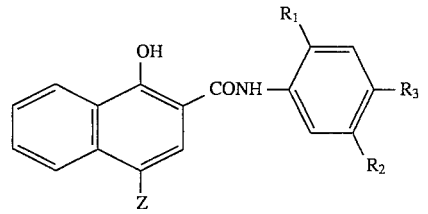

wherein:

Z is a development inhibitor moiety;

$R_1$ is selected from an alkoxy group, a phenoxy group and halogen;

$R_2$ is selected from the group consisting of an alkyl group, a phenyl group, an alkoxy group, an alkoxycarbonyl group, and a halogen; with the provisoes that when $R_2$ is a halogen, $R_1$ is selected from an alkoxy or phenoxy group, and when $R_2$ is an alkoxycarbonyl group, $R_1$ is an alkoxy group and Z is an inhibitor moiety other than a 1-phenyl-1H-tetrazole-5-thio group or a 2-carboxy-phenyl-thio group;

$R_3$ is selected from hydrogen, and an alkyl group; and $R_1$, $R_2$, and $R_3$ together contain at least 3 carbon atoms.

In one embodiment of the invention, the photographic element comprises a coupler as defined above, but wherein $R_2$ is selected from the group consisting of an alkyl group, a phenyl group, an alkoxy group, and a halogen; with the proviso that when $R_2$ is a halogen, $R_1$ is selected from an alkoxy or a phenoxy group.

In another embodiment, the photographic element comprises a coupler as defined above, but wherein $R_1$ is selected from an unsubstituted unbranched alkoxy group, and a substituted alkoxy group having less than six carbon atoms.

In yet another embodiment, the photographic element comprises a coupler as defined above, but wherein $R_1$, $R_2$, and $R_3$, together contain at least 9 carbon atoms.

The particular selection of substituents on the phenyl group of the 2-phenylcarbamoyl-1-naphthol image-modifying coupler, as well as the particular placement of the substitutents at ortho and meta positions, has been found to impart surprising characteristics to the photographic elements of the invention. Specifically, photographic elements comprising couplers in accordance with the invention exhibit proper hue, a resistance to dye crystallization, and a resistance to leuco cyan dye formation.

DETAILED DESCRIPTION OF THE INVENTION

The present invention concerns image-modifying couplers having the structure defined below, and photographic elements containing such couplers. Specifically, the invention concerns photographic elements comprising a cyan dye-forming 2-phenylcarbamoyl- 1-naphthol image-modifying coupler having the structure I

I

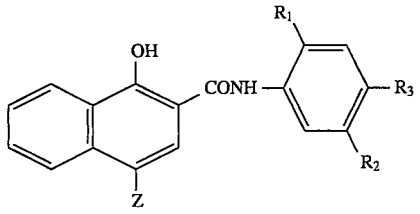

wherein:

Z is a development inhibitor moiety;

$R_1$ is selected from an alkoxy group (preferably unbranched and unsubstituted), a phenoxy group, and halogen;

$R_2$ is selected from the group consisting of an alkyl group, a phenyl group, an alkoxy group (preferably unbranched and unsubstituted), an alkoxycarbonyl group, and a halogen; with the provisoes that when $R_2$ is a halogen, $R_1$ is selected from an alkoxy or phenoxy group, and when $R_2$ is an alkoxycarbonyl group, $R_1$ is an alkoxy group and Z is an inhibitor moiety other than a 1-phenyl-1H-tetrazole-5-thio group or a 2-carboxy-phenyl-thio group;

$R_3$ is selected from hydrogen, and an alkyl group; and $R_1$, $R_2$, and $R_3$ together contain at least 3 carbon atoms. It is preferred that $R_1$, $R_2$, and $R_3$ together contain at least 9 carbon atoms. Optimally, the combined number of carbon atoms in $R_1$, $R_2$, and $R_3$ is from 12 to 30.

As used herein, substituents described without reference to branching or substitutions are to be construed as optionally containing branching and/or substitutions.

Also as used herein, alkoxycarbonyl group is to be defined as a group having the structure $COOR_5$, wherein $R_5$ is an alkyl group.

Preferably, the image-modifying coupler of the present invention comprises an inhibitor moiety, Z, selected from the structures:

II

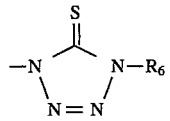

III

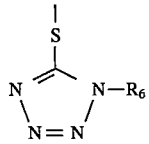

IV

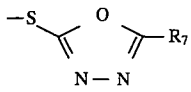

V

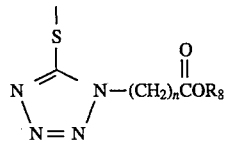

VI

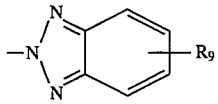

VII

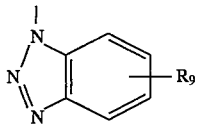

wherein:

$R_6$ is selected from the group consisting of an alkyl group containing from 1 to 8 carbon atoms, a benzyl group, and a phenyl group; optionally substituted, preferably With at least one alkoxy group;

$R_7$ is $R_{12}$ or —$SR_{12}$ wherein $R_{12}$ is selected from the group consisting of an alkyl group containing from 1 to 8 carbon atoms, a benzyl group, and a phenyl group; optionally substituted, preferably with at least one alkoxy group;

$R_8$ is an alkyl group containing 1 to 5 carbon atoms;

$R_9$ is selected from the group consisting of hydrogen, halogen, alkoxy, phenyl, —$COOR_{10}$ and $NHCOOR_{10}$, wherein $R_{10}$ is an alkyl group, or alkylthio group, or a phenyl group; and n is from 1 to 3.

More preferably, the image-modifying coupler of the present invention comprises an inhibitor moiety having structure III (above). In such instances, it is preferred that $R_6$ be an ethyl or a phenyl group. When interlayer-interimage effects are particularly desired, it is preferred that $R_6$ be an alkyl group, preferably an ethyl group.

In the more preferred embodiments of the invention, the couplers are defined as above (structure I) except that $R_2$ is selected from the group consisting of an alkyl group, a phenyl group, an alkoxy group, and a halogen; with the proviso that when $R_2$ is a halogen, $R_1$ is selected from an alkoxy or a phenoxy group. In the above instances, when either $R_1$ or $R_2$ is an alkoxy group, it is preferred that the group be unsubstituted and unbranched.

The couplers may also be defined as above, but where $R_1$ is selected from an unsubstituted unbranched alkoxy group, and a substituted alkoxy group having less than six carbon atoms.

Other preferred embodiments comprise couplers wherein $R_1$ is an unsubstituted, unbranched alkoxy group, $R_2$ is an unsubstituted alkyl group, $R_3$ is hydrogen, and $R_1$, $R_2$, and $R_3$ together contain at least 9 carbon atoms. Within this embodiment, it is even more preferred that $R_1$ be an n-dodecyloxy group and $R_2$ be a methyl group; or that $R_1$ be selected from an n-dodecyloxy group and an n-decyloxy group, and $R_2$ be a secondary butyl group.

In yet another preferred embodiment, the couplers are as defined above in structure I except that $R_1$ is an unsubstituted, unbranched alkoxy group, $R_2$ is an alkoxycarbonyl group, $R_3$ is hydrogen, and $R_1$, $R_2$, and $R_3$ together contain at least 9 carbon atoms. Within this embodiment, it is preferred that $R_1$ be an n-octyloxy group and $R_2$ be a 2-ethylhexoxycarbonyl group.

Examples of 2-phenylcarbamoyl-1-naphthol DIR couplers according to this invention include, but are not limited to, the following:

C1

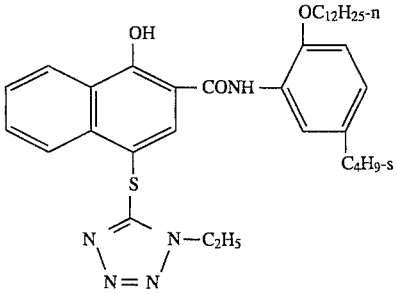

C2

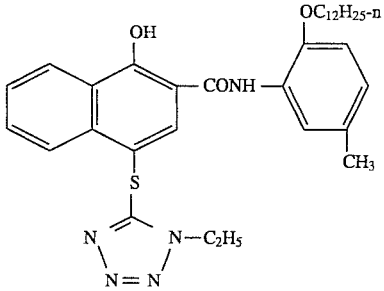

C3

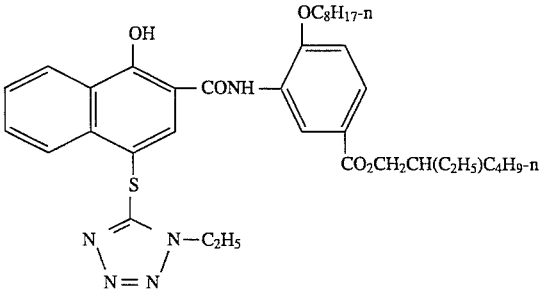

C4

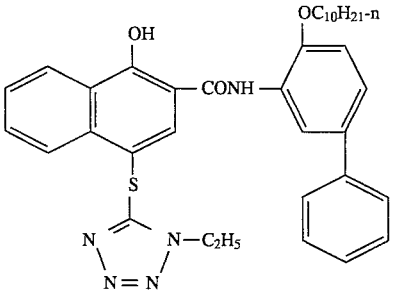

-continued

C5

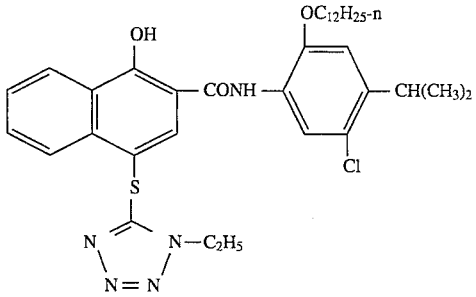

C6

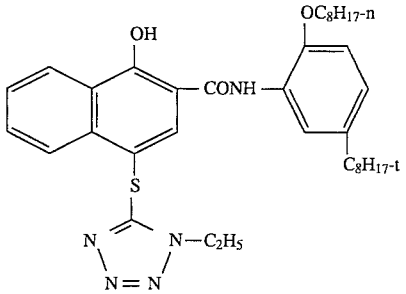

C7

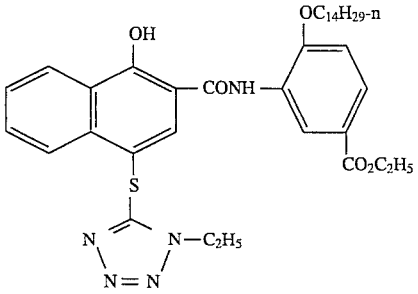

C8

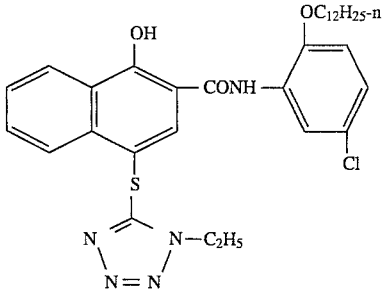

C9

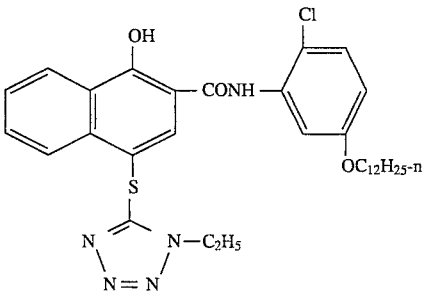

-continued
C10
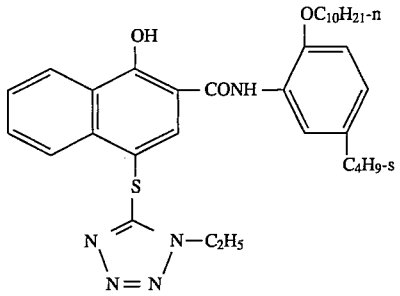
C11
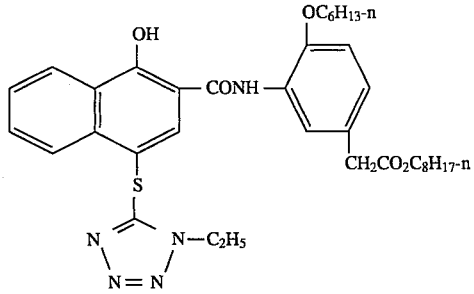
C12
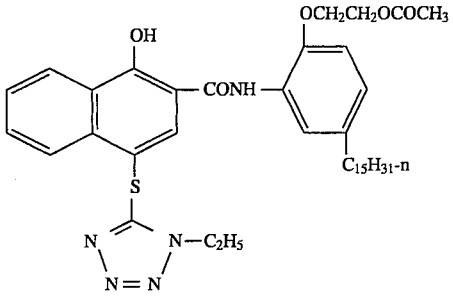
C13
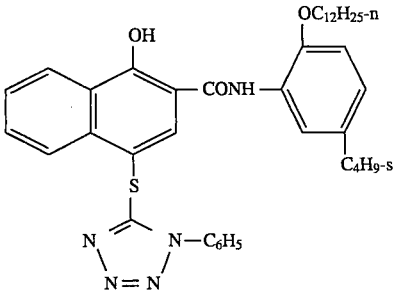
C14
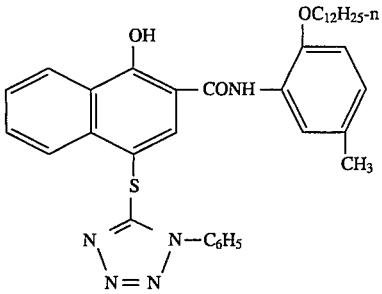
-continued
C15
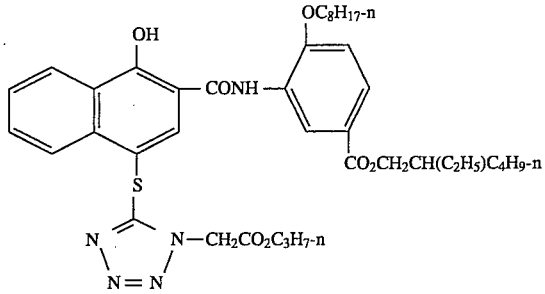
C16
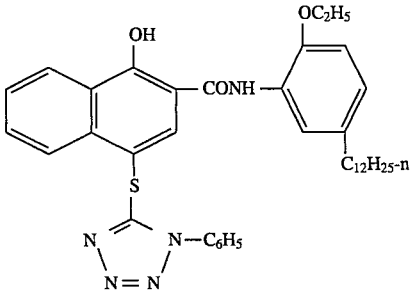
C17
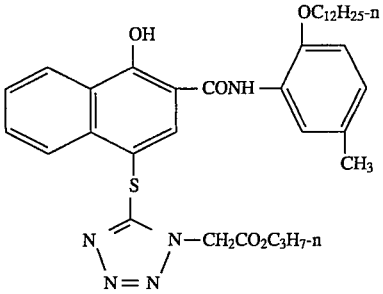
C18
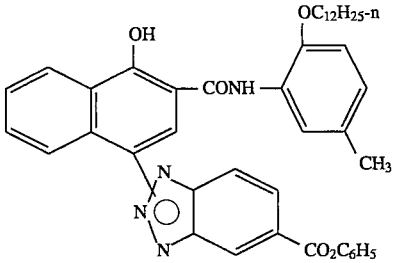
C19
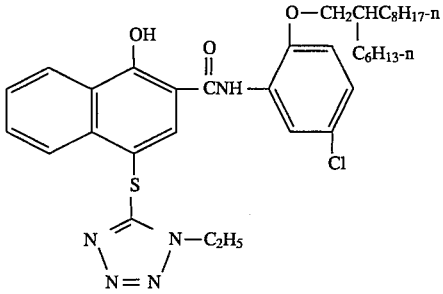

-continued

C20

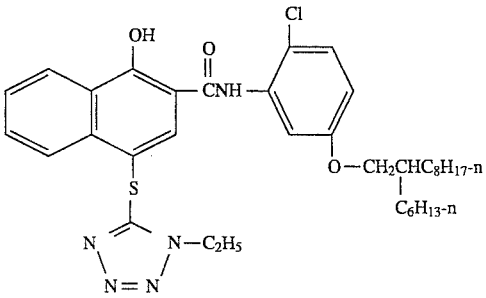

C21

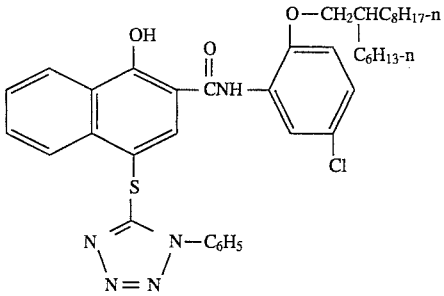

Most preferred are selected from the group consisting of:

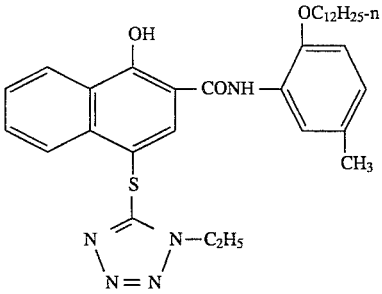

and

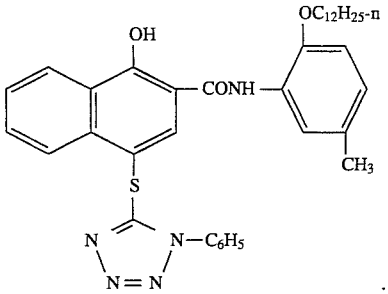

The photographic elements of the present invention can contain broad ranges of the above-described image-modifying couplers. Preferably, the image-modifying couplers are present in amounts between about 0.002 and about 0.40 grams per square meter. Ideally, they are present in amounts between about 0.01 and about 0.20 grams per square meter.

The development inhibitor releasing (DIR) couplers of this invention may be used in combination with yellow or magenta image couplers or image-modifying couplers. It is desired, though, that the 2-phenylcarbamoyl- 1-naphthol image-modifying couplers of this invention be used with cyan image couplers, including those of structures VIII, IX, X and XI, below:

VIII

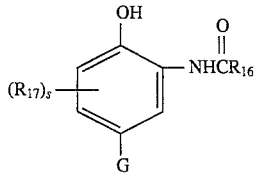

IX

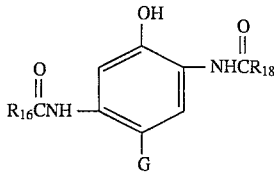

X

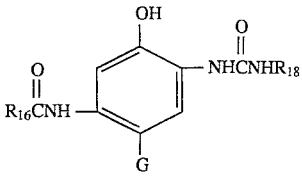

XI

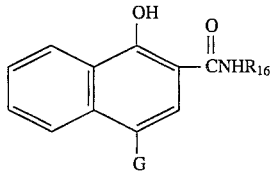

wherein:

s is from 0 to 3;

$R_{16}$ is a ballast group, such as an unsubstituted or a substituted alkyl group with at least 10 carbon atoms or a substituted phenyl group with at least 10 carbon atoms;

each $R_{17}$ is individually selected from halogens, alkyl groups of 1 to 4 carbon atoms and alkoxy groups of 1 to 4 carbon atoms;

$R_{18}$ is selected from unsubstituted or substituted alkyl groups, and unsubstituted or substituted aryl groups, wherein the substituents comprise one or more electron-withdrawing groups or atoms, such as cyano, chloro, fluoro, methylsulfonyl, or trifluoromethyl; and G is hydrogen or a coupling-off group that is not photographically useful. Examples of G include chlorine, an alkoxy group, an aryloxy group, a ballasted alkylthio or arylthio group, an acyloxy group, a carbonamido group, a sulfonamido group, and a nitrogen-containing heterocyclic group, such as a pyrazolyl, an imidazolyl, a succinimido or an hydantoinyl group.

Preferred image couplers for use in combination with the 2-phenylcarbamoyl-1-naphthol image-modifying couplers of this invention are the 2-phenylureido- 5-carbonamidophenol cyan dye-forming couplers of structure X, and preferably those in which $R_{18}$ is a p-cyanophenyl group and G is hydrogen or an aryloxy group. Useful weight ratios of the 2-phenylcarbamoyl- 1-naphthol image-modifying couplers of this invention to image coupler are from about 0.005:1.0 to about 2.0:1.0, depending on the layer and the type of image-modifying coupler.

Specific image couplers which may be utilized in the photographic element of the present invention include:

B1

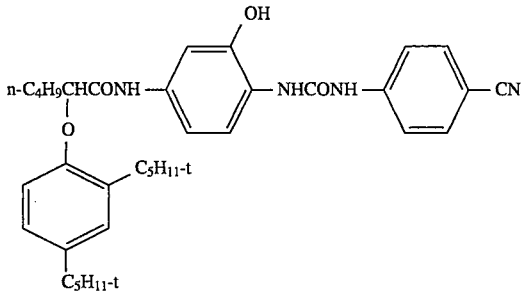

B2

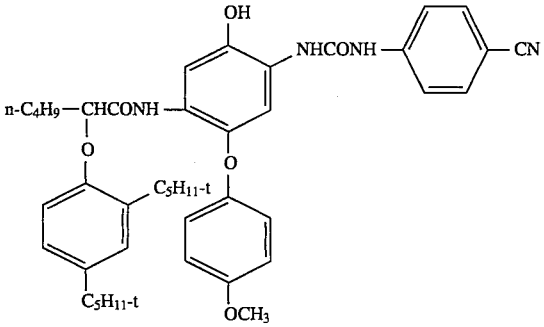

B3

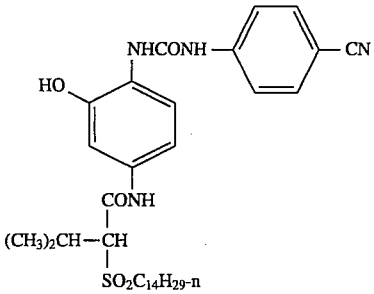

B4

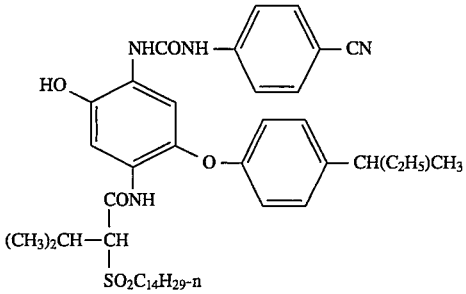

B5

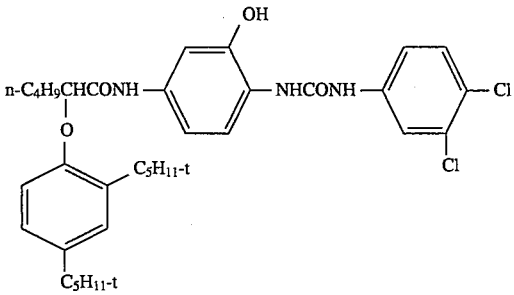

-continued

B6

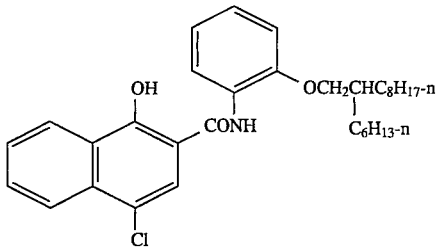

B7

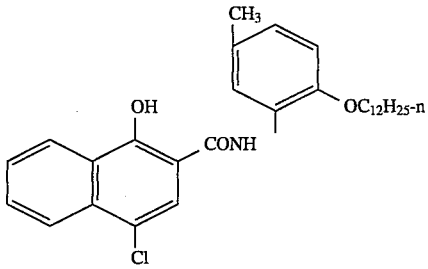

B8

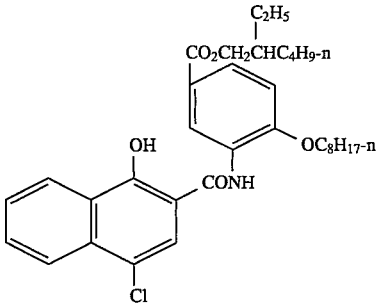

B9

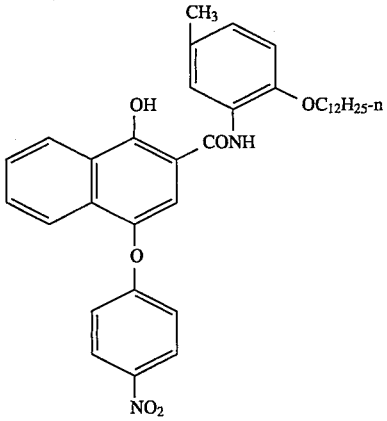

B10

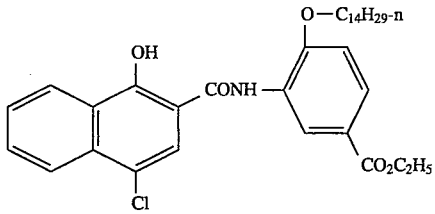

The image-modifying couplers of this invention can be utilized by dissolving them in high-boiling-temperature coupler solvents and then dispersing the organic coupler plus coupler solvent mixture as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase.

Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate), esters of aliphatic acids (e.g. dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl-)sulfoxide), sulfonamides (e.g. N,N-dibutyl-p-toluenesulfonamide) or hydrocarbons (e.g. dodecylbenzene). Additional coupler solvents and auxiliary solvents are noted in *Research Disclosure,* December 1989, Item 308119, p 993. Useful coupler:coupler solvent weight ratios range from about 1:0.1 to about 1:10, with about 1:0.2 to about 1:5.0 being preferred.

The photographic image-modifying couplers of the present invention may be employed in photographic materials in a manner well known in the photographic art. For example, a supporting substrate may be coated with a silver halide emulsion comprising a 2-phenylcarbamoyl- 1-naphthol DIR of the present invention. The 2-phenylcarbamoyl-1-naphthol image-modifying couplers may be coated with an image coupler, such as a 2-phenylureido-5-carbonamidophenol image coupler, imagewise exposed, and then developed in a solution containing a primary aromatic amine color developing agent.

The photographic elements of the present invention may be simple elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The element may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure,* December 1978, Item 17643, and *Research Disclosure,* December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.* The elements of the invention can comprise emulsions and addenda described in these publications and publications referenced in these publications.

The silver halide emulsions employed in the elements of this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure,* Item 308119, cited above, Section IV.

Suitable vehicles for the emulsion layer and other layers of elements of this invention are described in *Research Disclosure,* Item 308119, Section IX and the publications cited therein.

Besides the 2-phenylcarbamoyl-1-naphthol DIR couplers described herein, the elements of this invention can include additional couplers as described in Research Disclosure, Section VII, paragraphs D, E, F, and G and the publications cited therein. The additional couplers can be incorporated as described in Research Disclosure, Section VII, paragraph C, and the publications cited therein.

The photographic elements of this invention can contain brighteners (*Research Disclosure*, Section V), antifoggants and stabilizers (*Research Disclosure*, Section VI), antistain agents and image dye stabilizers (*Research Disclosure*, Section VII, paragraphs I and J), light absorbing and scattering materials (*Research Disclosure*, Section VIII), hardeners (*Research Disclosure*, Section X), coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein. , The photographic elements of the invention can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid. With negative-working silver halide, the processing step described above provides a negative image. The described elements are preferably processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not from dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

Preparation of the 2-phenylcarbamoyl-1-naphthol couplers of this invention is illustrated by the following synthetic example.

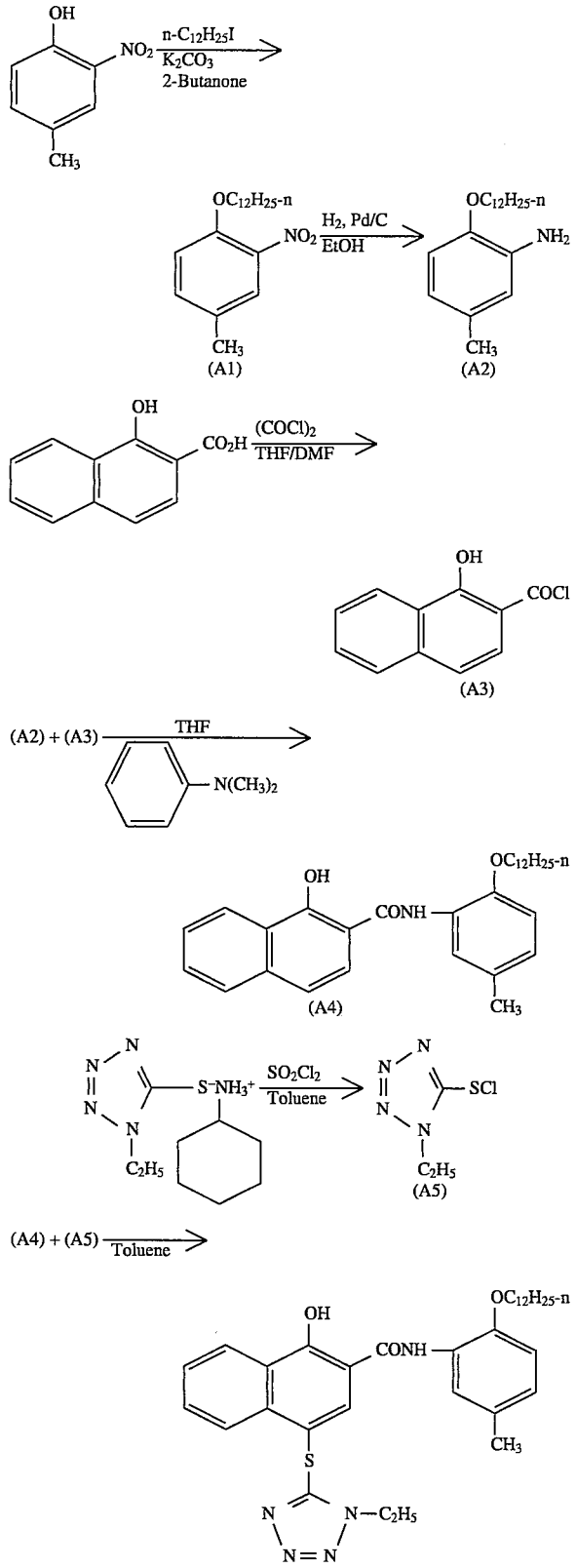

SYNTHESIS EXAMPLE A

Synthesis of the inventive DIR coupler C2 is shown schematically below and described in detail in the subsequent paragraphs.

Compound (A1): A mixture of 4-methyl-2-nitrophenol (50.0 g, 0.33 mol), 1-iodododecane (94.8 g, 0.32 mol), potassium carbonate (220.0 g, 1.6 mol) and 2-butanone (700 mL) was stirred and heated to reflux overnight. The mixture was then cooled to room temperature and poured into water, and the resulting aqueous mixture was extracted with ether. Ether extracts were combined and washed with water. The extract was then dried with magnesium sulfate and filtered. The solvent was removed on a rotary evaporator giving 96.0 g of compound (A1) as an oil (91% yield).

Compound (A2)

Compound (A1) was dissolved in 500 mL of ethanol and a catalytic amount of palladium on charcoal was added. The mixture was shaken for 18 hours under a hydrogen atmosphere (3 atm). The catalyst was removed by filtration through Celite, and the solvent was then removed under reduced pressure. The resulting, reddish oil was chromatographed on a silica gel column using 95:5 ligroin:ethyl acetate as the eluant. Upon solvent evaporation, 64.0 g of (A2) was obtained as a yellow oil (73%).

Compound (A3)

A 12.9 g (0.069 mol) quantity of 1-hydroxy-2-naphthoic acid was dissolved in 250 mL of tetrahydrofuran containing 2 drops of N,N-dimethylformamide as a catalyst. Oxalyl chloride (6.6 mL, 0.076 mol) was added dropwise. The reaction mixture was stirred for one hour, at which point all gas evolution had ceased. The solvent was removed on a rotary evaporator yielding (A3), which was used immediately without further purification.

Compound (A4)

Compound (A3) was redissolved in 150 mL of tetrahydrofuran. A solution of 20 g (0.069 mol) of (A2) and 9.7 mL (0.076 mol) of N,N-dimethylaniline in 100 mL tetrahydrofuran was then added. The reaction mixture was stirred overnight at ambient temperature and then poured into a solution of dilute hydrochloric acid. The aqueous mixture was extracted with ethyl acetate, and the extracts were dried over magnesium sulfate and filtered. The filtrate was concentrated to an oil, which was dissolved in ligroin and then filtered to remove insoluble material. The product was eluted through a silica gel column using ethyl acetate. The resulting oil was slurried in ether/ligroin to give 10.3 g (32%) of (A4) as a yellow solid.

Compounds (A5) and C2

Compound (A5) was prepared by adding 1.8 mL (0.022 mol) of sulfuryl chloride dropwise at room temperature to a slurry of the cyclohexylamine salt of 1-ethyl-2-tetrazoline-5-thione (4.8 g, 0.021 mol) in 100 ml of toluene. After stirring for 15 min, a solution of 9.6 g (0.021 mol) of (A4) in 100 mL of toluene was added in one portion. After stirring the mixture for three hours at room temperature, ethyl acetate was added to produce a total volume of one liter. The solution was then washed with a 10% hydrochloric acid solution, dried over magnesium sulfate and filtered. On removal of the solvent a light brown solid was obtained, which was recrystallized once in acetonitrile and once in ethyl acetate. The product, a white solid (MP=116° C.), was confirmed as C2 by NMR spectroscopy. The yield was 7.3 g (59%).

EXAMPLES

In the following examples, coupler solvent S1 refers to tritolyl phosphate (mixed isomers), coupler solvent S2 is dibutyl phthalate, coupler solvent S3 is 1,4-cyclohexylenedimethylene bis(2-ethylhexanoate), coupler solvent S4 is N,N-diethyldodecanamide, coupler solvent S5 is N-butylacetanilide and coupler solvent S6 is N,N-dibutyldodecanamide.

Example 1

Illustration of the Advantageous Properties of the Image-Modifying Couplers of this Invention in a Simplified Test Format In order to rapidly evaluate the 2-phenylcarbamoyl-1-naphthol image-modifying couplers of this invention, simple testing procedures were developed for initial comparisons. For these tests, each image-modifying coupler or, in some cases, a four-equivalent parent coupler was coated on a transparent acetate support as a single layer in a gelatin binder. The hardened films were then immersed in a solution containing 4-amino-3-methyl-N-ethyl-N-(β-hydroxyethyl)aniline sulfate (the developer used in the C-41 process) and potassium ferricyanide buffered at a pH of 10. The ferricyanide oxidized the developer, which then reacted with the coupler to form dye. The dye absorption spectrum was then measured on a spectrophotometer. Samples were stored at low temperatures and spectra were remeasured to determine the extent of dye crystallization. The extent of reduction to leuco cyan dye (LCD formation) in a simulated seasoned bleach was also determined for the film samples using the procedures described below. In certain instances the testing procedures were carried out on coatings of the corresponding four-equivalent parent coupler.

The specific dispersion preparation and coating procedures used for the DIR couplers are illustrated below. An oil phase consisting of 0.08 g of the DIR coupler, 0.16 g of the coupler solvent S1, and 1.6 mL of ethyl acetate auxiliary solvent, was dispersed in an aqueous phase containing 20.2 mL of water, 1.0 g of gelatin, and 0.1 g of the sodium salt of tri-isopropylnaphthylenesulfonic acid (a surfactant) by passing the mixture through a colloid mill in a manner known in the art. Formaldehyde (0.008 g) was added to the dispersion which was then coated on a cellulose acetate support. The aim DIR laydown was 0.36 g/sq m and the aim gelatin laydown was 4.5 g/sq m. The ethyl acetate evaporated upon coating.

To convert the couplers to dye, the hardened films were immersed for two minutes in a pH=10 borate buffer solution containing 2.0 g/L of 4-amino-3-methyl-N-ethyl-N-(β-hydroxyethyl)-aniline sulfate, 0.25 g/L of sodium sulfate, and 12.0 g/L of potassium ferricyanide. This simulated the chromogenic development in photographic materials. The dye-containing films were then immersed in a 2% acetic acid solution for one minute and then washed for five minutes at 27° C. After the films were dry, the spectra were measured. The spectral absorption maxima (lambda max values) are reported in the tables below. Most film samples had a density of approximately 1.5 at the absorption maximum near 700 nm.

To evaluate the propensity for dye crystallization on cold storage, samples were placed in a freezer at −18° C. for 48 hr. The absorption spectra were then remeasured on a spectrophotometer. The density loss percentages at the absorption maxima due to dye crystallization are listed in the tables below.

To probe the propensity for reduction of cyan dye to the leuco form in seasoned bleaches (LCD formation), or in bleaches of weak oxidizing strength, a test was designed to simulate the bleaching step of a photographic process, such as the C-41 process. After recording the absorption spectra, the dye-containing films were placed for three minutes in a solution consisting of 50 mL of water, 50 mL of fresh Bleach II used in the C-41 process, 2.0 g of ferrous sulfate heptahydrate, 2.5 g of the dipotassium salt of (ethylenedinitrilo)-tetraacetic acid (EDTA) and 1.5 mL of ammonium hydroxide reagent. The pH of the solution was adjusted to 4.75 with acetic acid prior to immersion of the film samples. This procedure simulated the early stages of the C-41 bleach process, in which ferrous ion concentrations are quite high due to reduction of iron EDTA upon oxidation of developed silver. The film samples were then placed for four minutes in a solution consisting of 100 mL of fresh C- 41 Bleach II, 1.0 g/L of ferrous sulfate heptahydrate and 0.2 g/L of dipotassium EDTA adjusted to a pH of 4.75. This simulated the ferrous ion levels and acidity of seasoned bleaches actually observed in seasoned processing solutions encountered in trade laboratories. The films were then washed and dried, and their spectra were remeasured. The percentage losses in density at lambda max due to leuco cyan dye formation are also listed in the tables below. Initial densities were approximately 1.5.

Test data for example 2-phenylcarbamoyl-1-naphthol DIR couplers of this invention and for comparative DIR couplers are provided in Table IA. Structures of the comparative DIR couplers D1 through D6 are given below.

D1

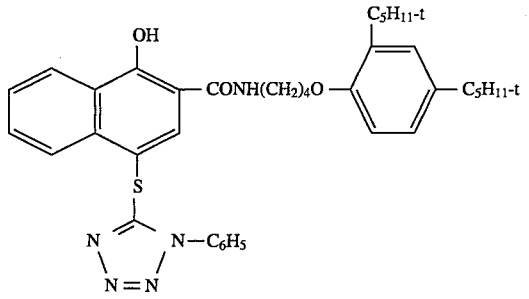

D2

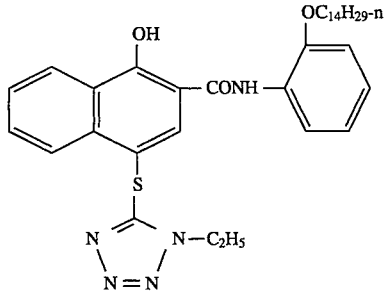

D3

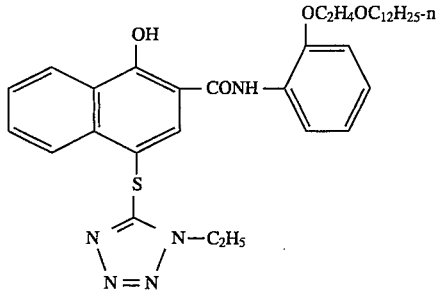

D4

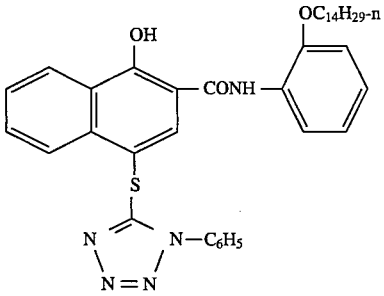

-continued

D5

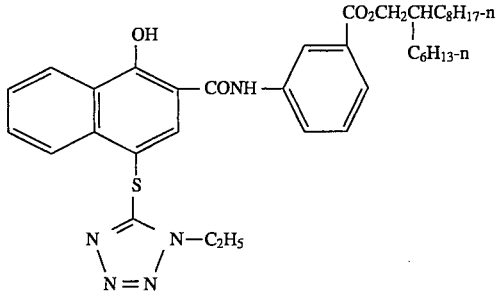

D6

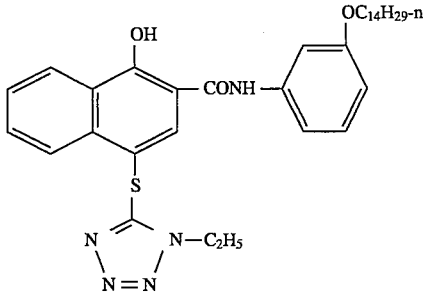

TABLE IA

| Coupler | Coupler Solvent | Weight Ratio[1] | Lambda Max (nm)[2] | Density Loss % at Lambda Max 48 hr @ −18° C.[3] | Density Loss % in Simulated Seasoned Bleach[4] (LCD Test) |
|---|---|---|---|---|---|
| 1 D1 | S1 | 1:2 | 694 | 3.0 | 12.3 |
| 2 D2 | S1 | 1:2 | 699 | 62.0 | 0.2 |
| 3 D4 | S1 | 1:2 | 699 | 7.4 | 0.5 |
| 4 D3 | S2 | 1:2 | 696 | 61.5 | 2.4 |
| 5 D4 | S1 | 1:2 | 700 | 78.6 | 2.9 |
| 6 D5 | S1 | 1:2 | 712 | 9.8 | 1.8 |
| 7 D5 | S2 | 1:2 | 708 | 29.2 | 4.4 |
| 8 D6* | S6 | 1:4 | 707 | 2.8 | 9.5 |
| 9 C1 | S1 | 1:2 | 700 | 0.0 | 0.5 |
| 10 C1 | S2 | 1:2 | 697 | 0.0 | 0.4 |
| 11 C1 | S6 | 1:4 | 696 | 2.1 | 1.8 |
| 12 C2 | S1 | 1:2 | 699 | 0.0 | 0.8 |
| 13 C2 | S2 | 1:2 | 695 | 1.6 | 1.8 |
| 14 C3 | S1 | 1:2 | 705 | 0.0 | 0.1 |
| 15 C3 | S2 | 1:2 | 704 | 1.8 | 0.6 |
| 16 C4 | S1 | 1:2 | 704 | 0.0 | 0.8 |
| 17 C7 | S1 | 1:2 | 703 | 0.0 | 0.8 |
| 18 C8 | S1 | 1:2 | 705 | 1.0 | 0.2 |
| 19 C10 | S1 | 1:2 | 701 | 0.0 | 0.4 |
| 20 C13 | S1 | 1:2 | 701 | 0.0 | 0.0 |
| 21 C14 | S1 | 1:2 | 700 | 0.0 | 1.4 |

[1]Coupler to coupler solvent weight ratio
[2]Spectral absorbtion maxima
[3]Density loss percentages at the absorption maxima due to dye crystallization
[4]Density loss percentages at the absorption maxima due to leuco cyan dye formation
*Coupler D6 had to be coated with the solvent S6 to avoid crystallization.

From the data in Table IA, it is evident that all of the comparative DIR couplers D1 through D6 yield dyes which undergo either a large loss in red density on cold storage (due to crystallization), or a large loss in red density in a simulated seasoned bleach (due to leuco cyan dye formation), or both. For example, the dye derived from the comparative 2-alkylcarbamoyl- 1-naphthol coupler D1 shows a particularly large loss (12.3%) in red density in the simulated seasoned bleach LCD test. The comparative 2-phenylcarbamoyl-1-naphthol coupler D2, by contrast, yields a dye that shows little loss in red density in the LCD test. However, this dye shows a 62% loss in red density upon cold storage. Data for the other comparative couplers indicates that they all exhibit substantial loss in density due to either crystallization or leuco cyan dye formation (or due to both).

In marked contrast to the comparative couplers, the couplers of this invention, C1, C2, C3, C4, C7, C8, C10, C13, and C14 all yield dyes that show almost no density loss on cold storage and less than two percent density loss in the LCD test. C1, for example, shows no density loss due to crystallization in coupler solvents S1 and S2. It also shows only a 0.5 percent loss, or less, due to leuco cyan dye formation in the same coupler solvents.

Couplers C1, C2, C10, C13, and C14 are the most preferred couplers of those tested. This is because in coupler solvent S1, they yield dyes with lambda values at, or near, 700 nm. Couplers which yield dyes with lambda max values significantly above 700 nm are somewhat bathochromic. As a result, they are less desirable for optimum printing characteristics in color negative materials. This is because a typical color paper onto which a negative is printed has a maximum sensitivity in the region of about 700 nm. Dyes that have an absorption maximum between about 703 nm and 709 nm, though effective, do not modulate light as efficiently in the region of maximum paper sensitivity as dyes which have absorption maxima closer to 700 nm. Dyes that have an absorption maximum above about 709 nm are particularly inefficient and are thus undesirable.

Table IB provides comparative data for a variety of types of four-equivalent 2-phenylcarbamoyl- 1-naphthol couplers to illustrate the shortcomings of dyes derived from parent structures that are outside the scope of the claimed invention. Only coupler E8 has the substituents, and locations thereof, to place it (with an inhibitor moiety) and the dye it yields within the scope of invention; and only E8 yields a dye with proper hue, and suitable resistance to crystallization and leuco dye formation. The structures of couplers E1 through E14 are given below.

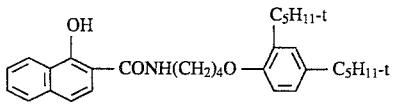

E1

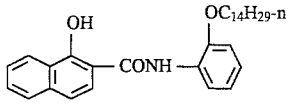

E2

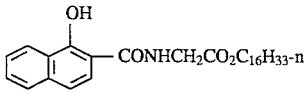

E3

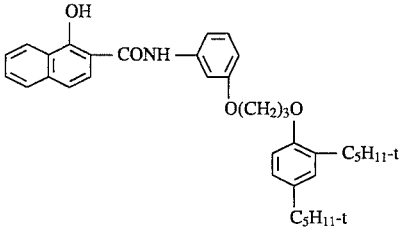

E4

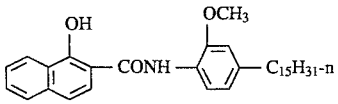

E5

-continued

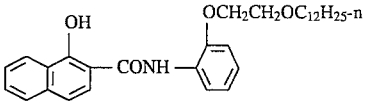

E6

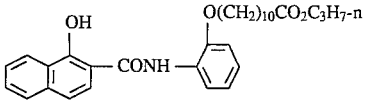

E7

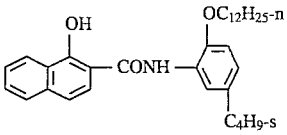

E8

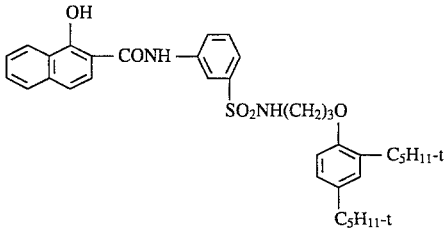

E9

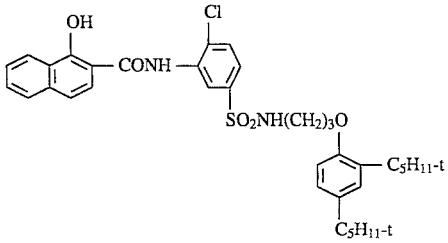

E10

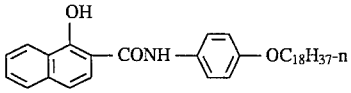

E11

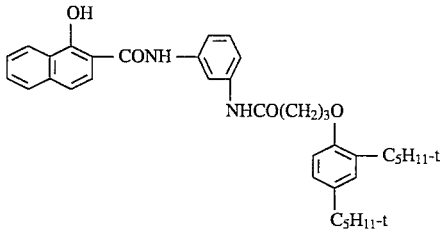

E12

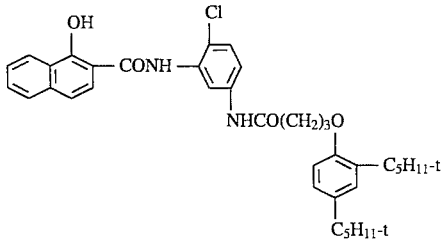

E13

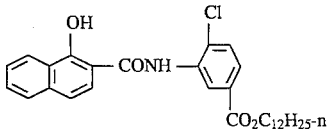

E14

TABLE IB

| Coupler | Coupler Solvent | Weight Ratio[1] | Lambda Max (nm)[2] | Density Loss % at Lamb-da Max 48 hr @ −18° C.[3] | Density Loss % in Simulated Seasoned Bleach[4] (LCD Test) |
|---|---|---|---|---|---|
| 1 E1 | S1 | 1:2 | 693 | 0.0 | 17.2 |
| 2 E2 | S1 | 1:2 | 700 | 81.4 | 5.3* |
| 3 E3 | S1 | 1:2 | 694 | 1.2 | 15.7 |
| 4 E4 | S1 | 1:2 | 710 | 0.3 | 6.0 |
| 5 E5 | S1 | 1:2 | 700 | 16.4 | 2.6 |
| 6 E6 | S2 | 1:2 | 698 | 82.1 | 2.2 |
| 7 E7 | S1 | 1:2 | 702 | 54.6 | 1.6 |
| 8 E8 | S1 | 1:2 | 701 | 0.0 | 1.4 |
| 9 E8 | S2 | 1:2 | 698 | 0.0 | 2.3 |
| 10 E8 | S6 | 1:4 | 697 | 0.0 | 3.1 |
| 11 E9 | S1 | 1:2 | 720 | 0.0 | 7.4 |
| 12 E10 | S1 | 1:2 | 724 | 28.9 | 1.3 |
| 13 E11 | S6 | 1:4 | 704 | 54.2 | 10.9 |
| 14 E12 | S1 | 1:2 | 710 | 1.1 | 7.6 |
| 15 E13 | S1 | 1:2 | 711 | 0.1 | 1.1 |
| 16 E14 | S1 | 1:2 | 715 | 0.8 | 0.8 |

[1]Coupler to coupler solvent weight ratio
[2]Spectral absorbtion maxima
[3]Density loss percentages at the absorption maxima due to dye crystallization
[4]Density loss percentages at the absorption maxima due to leuco cyan dye formation
*Dye crystallization during the LCD test procedure contributes to the red density losses for this film.

According to the data in Table IB couplers E2, E5, E6, E7, E10 and E11 all yield dyes that show substantial density losses at lambda max due to dye crystallization on cold storage. Couplers E1, E3, E4, E9, E11 and E12 all yield dyes that show substantial (greater than 5%) density losses at lambda max in the simulated seasoned bleach LCD test. Couplers E4, E9, E10, E12, and E13 also yield dyes with hues that are too bathochromic (lambda max greater than 709 nm) in S1. Only coupler E8, which is a four-equivalent analog (absent an inhibitor moiety) of the image-modifying couplers of this invention, yields a dye that has the proper hue (701 nm in S1), and that is resistant to crystallization on cold storage, and to reduction in a seasoned bleach.

Comparisons of coupler E9 to E10 and of coupler E12 to E13 illustrate that the addition of an ortho substituent in the phenyl ring can reduce the loss in red density in a seasoned bleach due to leuco dye formation. The image-modifying couplers of this invention contain suitable ortho substituents on the phenyl ring.

Example 2

Evaluation of the 2-Phenylcarbamoyl- 1-Naphthol Image-Modifying Couplers of this Invention in a Photographic Element The coating format in the diagram below was used for evaluation of the DIR couplers of this invention in a photographic element. The DIR couplers were coated at 1.08 mmol/sq m together with 0.646 g/sq m of silver as a 0.3 micrometer cubic silver bromochloride (1% Br) emulsion. Coupler dispersions were prepared by adding an oil phase containing 1.0 g of coupler, 1.0, 2.0 or 4.0 g of coupler solvent and 3.0 g of ethyl acetate to a solution of 3.0 g of gelatin and 0.3 g of the sodium salt of tri-isopropylnaphthalene sulfonic acid (a dispersing agent) in sufficient water to yield a total volume of 50 mL. The mixtures were then passed through a colloid mill to disperse the oil phase in the aqueous phase as small particles. The resulting dispersions contained two percent by weight of coupler.

| |
|---|
| 2.69 g/sq m Gelatin (Overcoat) |
| 0.129 g/sq m Bis(vinylsulfonylmethyl) Ether Hardener |
| 3.77 g/sq m Gelatin |
| 1.08 mmol/sq m DIR (e.g. 0.65 g/sq m D1) |
| Coupler Solvent @ 1:2 or 1:4 Coupler:Solvent by Weight |
| 0.646 g/sq m Silver as a Silver Bromochloride (1% Br) Emulsion |
| Cellulose Acetate Butyrate Support |

After hardening, the films were exposed through a step tablet on a 1B sensitometer and then subjected to a KODAK FLEXICOLOR™ C-41 process as described in more detail below. To evaluate the propensity for leuco cyan dye formation in a seasoned bleach, 35 mm film strips were exposed and slit in half. Both halves were then processed at the same time in C-41 developer, and placed in a stop bath to eliminate any variability due to continued coupling. Then, one half was processed in fresh C-41 Bleach II and the other half was processed in a simulated seasoned bleach (Bleach B). Bleach B consisted of fresh Bleach II to which was added 10.0 g/L of ferrous sulfate heptahydrate and 2.0 g/L of dipotassium EDTA dihydrate with the the bleach pH adjusted to 4.75. During processing in Bleach B, agitation was provided by nitrogen bubbling (as opposed to air bubbling for Bleach II) to minimize air oxidation of ferrous ion to ferric ion. Status M red densities(Dr) were measured versus exposure for the samples processed in fresh Bleach II and in simulated seasoned Bleach B. Status M red densities (Dr) were also measured for a set of processed film samples before and after cold storage for 48 hr at −18° C. Density losses were determined from an initial density of 1.0. Absorption spectra were measured for the processed films at a status M red density of about 1.2 on a spectrophotometer. Test results are summarized in Table II.

C-41 PROCESSING SOLUTIONS AND CONDITIONS

| | Solution | Processing Time | Agitation Gas |
|---|---|---|---|
| | C-41 Developer | 3' 15" | Nitrogen |
| | Stop Bath | 30" | Nitrogen |
| A) | Fresh Bleach II | 3' | Air |
| or B) | Seasoned Bleach B | 3' | Nitrogen |
| | Wash | 1' | None |
| | C-41 Fix | 4' | Nitrogen |
| | Wash | 4' | None |
| | PHOTO-FLO™ | 30" | None |
| | Processing Temperature 100° F. | | |

TABLE II

| Coupler | Coupler Solvent | Weight Ratio[1] | Lamb-da Max (nm)[2] | Dr Loss % (Status M) in 48 hr @ −18° C.[3] | Dr(Bleach B) - Dr (Bleach II) at Dr = 1.0*[4] |
|---|---|---|---|---|---|
| 1 D1 | S1 | 1:2 | 698 | 0.0 | −0.15 |
| 2 D2 | S1 | 1:2 | 700 | 22.1 | −0.01 |
| 3 D3 | S1 | 1:2 | 702 | 25.0 | +0.01 |
| 4 D3 | S2 | 1:2 | 694 | 28.4 | +0.02 |
| 5 D4 | S1 | 1:2 | 703 | 36.7 | −0.02 |
| 6 D5 | S1 | 1:2 | 715 | 0.0 | −0.04 |
| 7 D5 | S2 | 1:2 | 711 | 5.5 | −0.05 |
| 8 D6* | S6 | 1:4 | 708 | 0.0 | −0.15 |
| 9 C2 | S1 | 1:2 | 701 | 0.0 | −0.01 |
| 10 C2 | S2 | 1:2 | 696 | 0.0 | −0.02 |
| 11 C2 | S6 | 1:4 | 695 | 0.0 | −0.01 |

TABLE II-continued

| Coupler | Coupler Solvent | Weight Ratio[1] | Lamb-da Max (nm)[2] | Dr Loss % (Status M) in 48 hr @ −18° C.[3] | Dr(Bleach B) - Dr (Bleach II) at Dr = 1.0*[4] |
|---|---|---|---|---|---|
| 12 C3 | S1 | 1:2 | 708 | 0.0 | −0.01 |
| 13 C3 | S2 | 1:2 | 705 | 0.0 | −0.01 |
| 14 C4 | S1 | 1:1 | 707 | 0.0 | −0.01 |
| 15 C7 | S1 | 1:1 | 708 | 0.0 | −0.01 |
| 16 C8 | S1 | 1:1 | 709 | 0.0 | −0.01 |
| 17 C10 | S1 | 1:1 | 703 | 0.0 | −0.00 |
| 18 C13 | S1 | 1:1 | 703 | 0.0 | −0.00 |

[1]Coupler to coupler solvent weight ratio
[2]Spectral absorbtion maxima
[3]Red density loss percentages due to dye crystallization.
[4]Red density loss due to the leuco cyan dye formation
*Difference represents averages of two runs.

As is illustrated by the data in Table II, only the couplers of this invention yield dyes that have suitable hue, that do not lose red density on cold storage, and that undergo minimal loss of red density in a seasoned bleach solution. All of the comparative couplers yield dyes with at least one deficiency. Films with comparative couplers D2, D3 and D4 show severe red density losses after 48 hr at −18° C. due to dye crystallization. The film containing D5 is too bathochromic, and in S2 it loses substantial red density on cold storage. The inventive C2 and C3 containing films show no such red density losses on cold storage, even in S2. Further, their lambda max values are close to the desired 700 nm.

The films containing D1, D5 and D6 show unacceptably high losses in red density in simulated seasoned Bleach B. D6 even required the use of a different coupler solvent, namely S6 (at 1:4) to avoid coupler crystallization. Furthermore, even with the different coupler solvent, the dye derived from D6 showed a high Dr loss in Bleach B (−0.15). The dyes derived from the inventive couplers, by contrast, show negligible losses in dye density due to dye crystallization and leuco cyan dye formation.

In the course of determining the couplers of the present invention, it was found that other types of novel two- (or four) equivalent 2-phenylcarbamoyl-1-naphthol image-modifying couplers also exhibit a resistance to leuco cyan dye formation and crystallization at low temperatures. These other image-modifying couplers, which have coupling off groups other than an untimed or unswitched development inhibitor moiety, include bleach accelerator releasing couplers (BARCs), timed or switched development inhibitor releasing couplers (DIAR couplers), and masking couplers. The BARCs preferably have the structure:

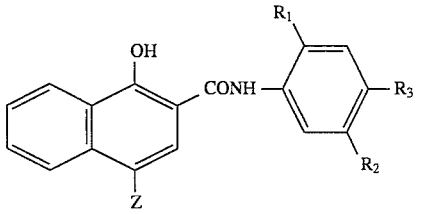

wherein:

$R_1$ is selected from an alkoxy group, a phenoxy group and halogen;

$R_2$ is selected from the group consisting of an alkyl group, a phenyl group, an alkoxy group, a halogen, and an alkoxycarbonyl group;

$R_3$ is selected from hydrogen, and an alkyl group;

$R_1$, $R_2$, and $R_3$ together contain at least 3 carbon atoms; and

Z is a bleach accelerator group.

The DIAR couplers preferably have the structure:

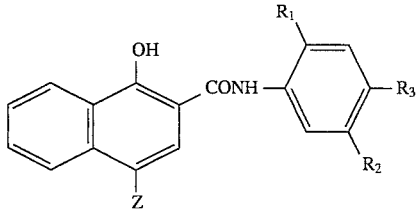

wherein:

$R_1$ is selected from an alkoxy group, a phenoxy group and halogen;

$R_2$ is selected from the group consisting of an alkyl group, a phenyl group, an alkoxy group, an alkoxycarbonyl group, and a halogen;

$R_3$ is selected from hydrogen, and an alkyl group;

$R_1$, $R_2$, and $R_3$ together contain at least 3 carbon atoms; and

Z is a development inhibitor releasing group comprising a timing group or switch and a development inhibitor moiety. Preferably, Z is selected from the structures:

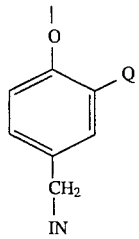

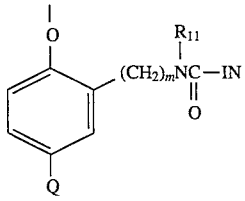

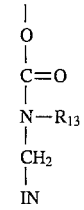

wherein:

m is 0 or 1;

Q is an electron withdrawing group;

$R_{11}$ is selected from an alkyl group containing from 1 to 8 carbon atoms, and a phenyl group;

$R_{13}$ is an alkyl group; and

IN is a development inhibitor moiety.

Specific DIAR couplers within the scope of this definition include, but are not limited to, the following:

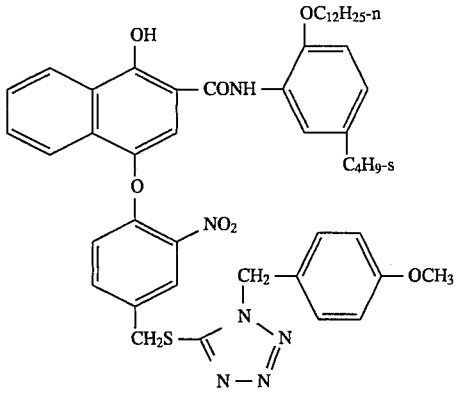

C22

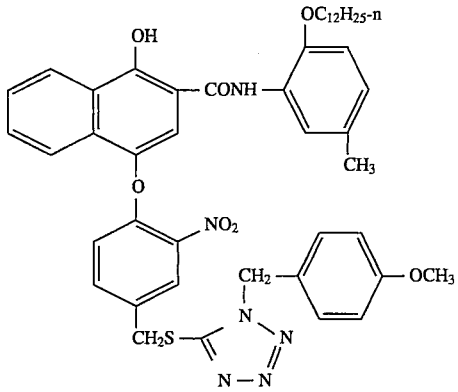

C23

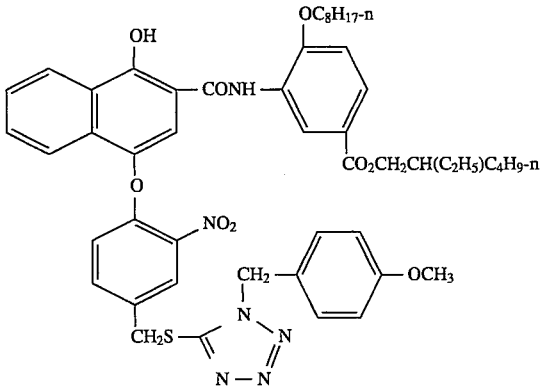

C24

The masking couplers preferably have the structure:

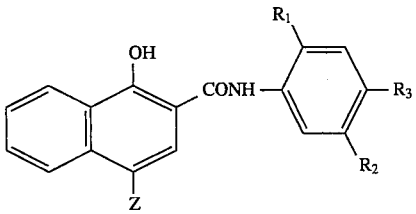

wherein:

$R_1$ is selected from an alkoxy group, a phenoxy group, and halogen;

$R_2$ is selected from the group consisting of an alkyl group, a phenyl,group, an alkoxy group, an alkoxycarbonyl group, and a halogen;

$R_3$ is selected from hydrogen, and an alkyl group;

$R_1$, $R_2$, and $R_3$ together contain at least 3 carbon atoms; and

Z is a coupling off group having the formula

—A—B—N=N—D wherein:

A represents a divalent linking group which releases from the coupler upon reaction of the coupler with oxidized developer to cleave Z from the remainder of the coupler;

B is a divalent aromatic group; and

D is an aryl group containing at least one sulfonate or carboxyl group.

In the preferred embodiments of the present invention, any or all of the above-described BARCs, DIAR couplers, and masking couplers, are combined with the novel two-equivalent 1-phenylcarbamoyl-1-naphthol image-modifying couplers of the present invention, and incorporated into a photographic element. Preferably, the same four equivalent parent coupler is utilized as the basis for all the cyan dye forming DIR couplers, DIAR couplers, BARCs, and masking couplers. The following examples describe some of these combinations and their advantages.

Example 3

Use of the 2-Phenylcarbamoyl-1-Naphthol DIR Couplers of this Invention, and DIAR Couplers, in a Multilayer Film This example illustrates the use of the DIR couplers of this invention, and the DIAR couplers as described above, to construct multilayer films that do not show significant losses in red density upon cold storage after processing, and that do not show high losses in red density when processed in a seasoned bleach solution. The multilayer film structure is shown in the diagram below. Dispersions of the various components were prepared and coated by methods known in the art. Component laydowns in g/sq m are listed in parentheses in this and subsequent examples. In the coating diagram, single lines mark the boundaries between layers and double lines differentiate between separate coating melts in the same layer that are mixed immediately prior to coating. Chemical formulas of the coated components F1 through F13 are given after the coating diagram.

MULTILAYER STRUCTURE FOR EXAMPLE 3

| | |
|---|---|
| 1 Protective Overcoat: | Polyvinyltoluene Matte Beads (0.038) in Gelatin (0.888) |
| 2 UV Absorbing Layer: | Silver Halide (0.215 Ag) Lippmann Emulsion<br>F1 (0.108) + S3 (0.108)<br>F2 (0.108) + S3 (0.108)<br>Gelatin (0.538) |
| 3 Fast Yellow Layer: | F3 (0.161) + S2 (0.081)<br>F4 (0.054) + S2 (0.054)<br>F5 (0.003) S4 (0.003)<br>Silver Iodobromide Emulsion (0.430 Ag)<br>3% Iodide T-grain (1.10 × 0.12 μm)<br>Gelatin (0.791) |
| 4 Slow Yellow Layer: | F3 (1.022) + S2 (0.511)<br>F4 (0.168) + S2 (0.168)<br>Silver Iodobromide Emulsion (0.274 Ag)<br>3% Iodide T-grain (0.57 × 0.12 μm)<br>Silver Iodobromide Emulsion (0.118 Ag)<br>3% Iodide T-grain (0.52 × 0.09 μm)<br>Gelatin (1.732) |

-continued

| MULTILAYER STRUCTURE FOR EXAMPLE 3 | |
|---|---|
| 5 Interlayer: | Carey-Lea Silver (0.043)<br>F6 (0.054) + S4 (0.027)<br>Gelatin (0.861)<br>Palladium Antifoggant |
| 6 Fast Magenta Layer: | F7 (0.258) + S1 (0.258)<br>F8 (0.054) + S1 (0.108)<br>Silver Iodobromide Emulsion (0.538 Ag)<br>3% Iodide T-grain (1.05 × 0.12 μm)<br>Silver Iodobromide Emulsion (0.753 Ag)<br>3% Iodide T-Grain (0.75 × 0.14 μm)<br>Gelatin (1.119) |
| 7 Slow Magenta Layer: | F7 (0.161) + S1 (0.161)<br>F9 (0.108) + S1 (0.215)<br>Silver Iodobromide Emulsion (0.473 Ag)<br>3% Iodide T-Grain (0.55 × 0.08 μm)<br>Silver Iodobromide Emulsion (0.495 Ag)<br>3% Iodide T-Grain (0.52 × 0.09 μm)<br>Gelatin (2.916) |
| 8 Interlayer: | F6 (0.054) + S4 (0.027)<br>Gelatin (1.291) Palladium Antifoggant |
| 9 Fast Cyan Layer: | See Below |
| 10 Slow Cyan Layer: | See Below |
| 11 Anti-Halation Layer: | Grey silver (0.161)<br>F10 (0.025) + S1 (0.050)<br>F11 (0.129) + S3 (0.258)<br>F12 (0.090)<br>F13 (0.008) + S2 (0.038)<br>F6 (0.108) + S3 (0.054)<br>Gelatin (2.690) |
| 12 Cellulose Acetate Support | |

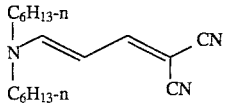

F1

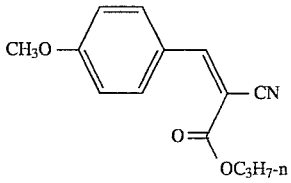

F2

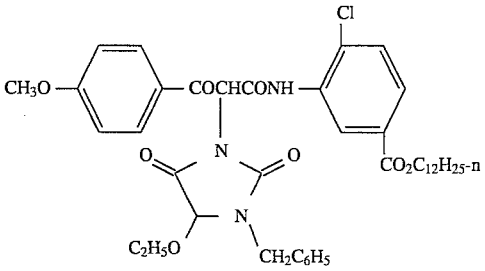

F3

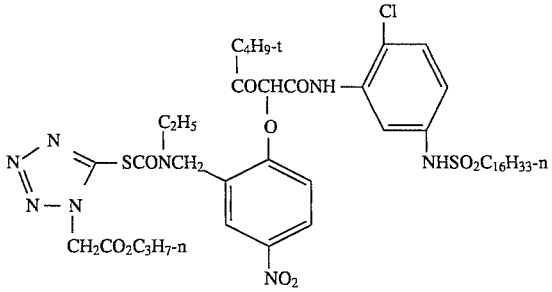

F4

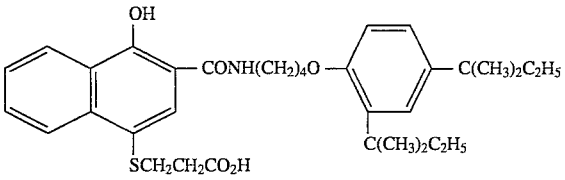

F5

-continued
F6
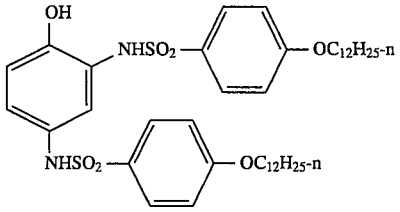
F7
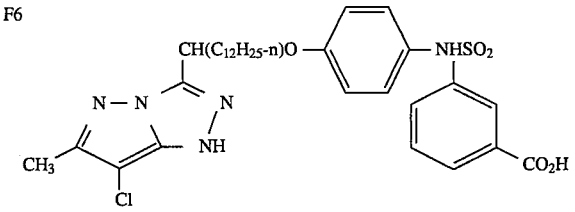
F8
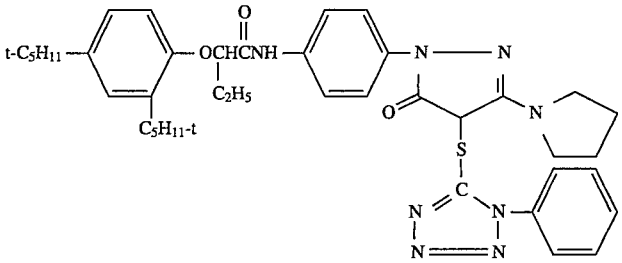
F9
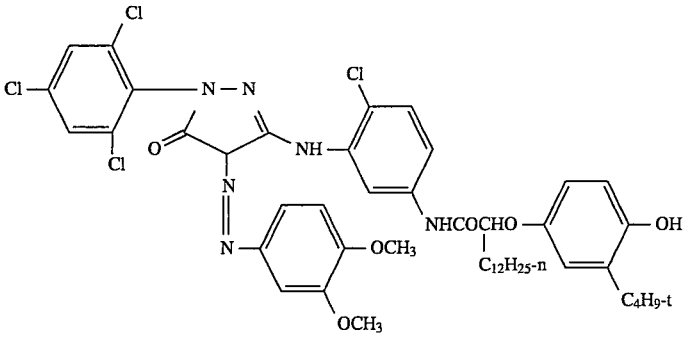
F10
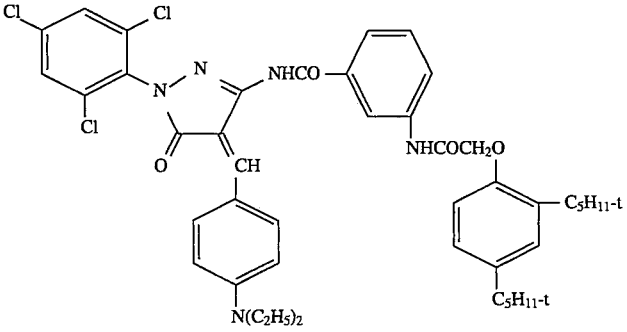
F11
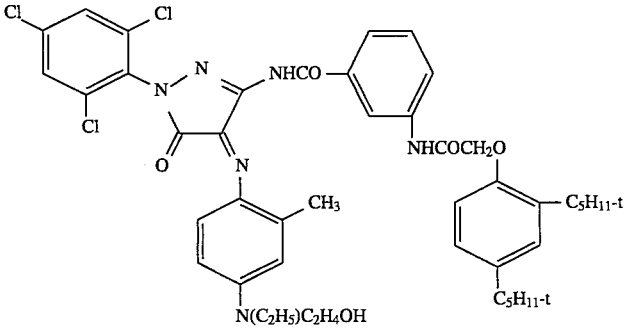

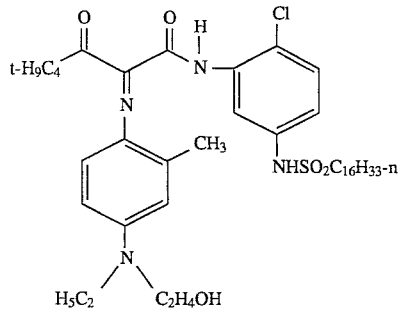

-continued

F12

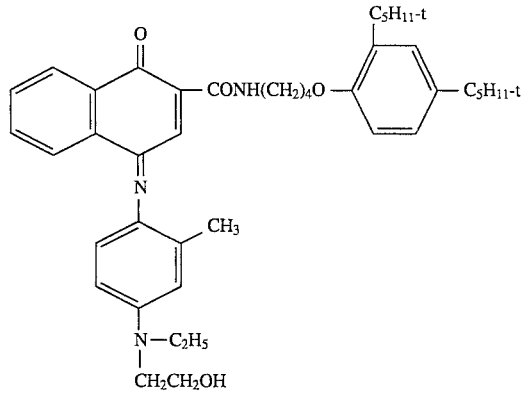

F13

The red-sensitive, cyan dye-forming layers are most relevant for demonstrating the advantages of the combination of image-modifying couplers. The compositions of these layers are shown in the diagram below. In this Example, DIR couplers of the invention are compared to coupler D2, and the DIAR couplers are compared to coupler D7. Coupler D7, which is outside the scope of the description of DIAR couplers above, has the structure:

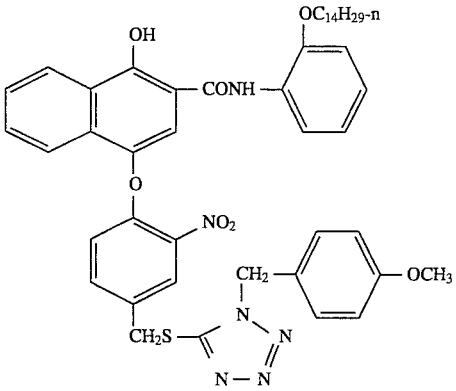

D7

The comparative data is presented in Table III. For entries IIIb–IIId only the DIR coupler D2 was replaced in the fast cyan layer. For entries IIIe–IIIg only the DIAR coupler D7 was replaced in both the fast and slow cyan layers. For entries IIIh–IIIj, D2 was replaced in the fast layer and D7 was replaced in the fast and slow layers. The various replacement couplers were substituted at equimolar laydowns.

| | |
|---|---|
| 9 Fast Cyan: | B1 (0.102) + S2 (0.051) |
| | Silver Iodobromide Emulsion (0.807 Ag) |
| | 6% Iodide T-grain (1.40 × 0.12 μm) |
| | Gelatin (1.506) |
| IIIa, IIIe–IIIg | D2 (0.065) + S1 (0.258) |
| or IIIb & IIIh | C1 (0.068) + S1 (0.271) |
| or IIIc & IIIi | C2 (0.064) + S1 (0.247) |
| or IIId & IIIj | C3 (0.072) + S1 (0.288) |
| IIIa–IIId | D7 (0.102) + S5 (0.204) |
| or IIIe & IIIh | C22 (0.105) + S5 (0.211) |
| or IIIf & IIIi | C23 (0.101) + S5 (0.202) |
| or IIIg & IIIj | C24 (0.110) + S5 (0.220) |
| 10 Slow Cyan: | B1 (0.689) + S2 (0.344) |
| | Gelatin (0.968) |
| | B1 (0.278) + S2 (0.135) |
| | F5 (0.011) + S4 (0.011) |
| | Silver Iodobromide Emulsion (1.31 Ag) |
| | 3% Iodide T-grain (0.75 × 0.14 μm) |
| | Silver Iodobromide Emulsion (1.16 Ag) |
| | 1.5% Iodide Cubic (0.31 μm) |

-continued

| | |
|---|---|
| | Gelatin (1.991) |
| IIIa–IIId | D7 (0.065) + S5 (0.129) |
| or IIIe & IIIh | C22 (0.067) + S5 (0.133) |
| or IIIf & IIIi | C23 (0.063) + S5 (0.127) |
| or IIIg & IIIj | C24 (0.070) + S5 (0.139) |

The DIR and DIAR coupler dispersions were prepared by methods known in the art. A typical procedure for the DIAR dispersions involved adding an oil phase consisting of a mixture of one part by weight of coupler plus two parts by weight of coupler solvent S5 to an aqueous phase containing 10% gelatin plus 0.3% of the sodium salt of tri-isopropylnaphthalenesulfonic acid (a dispersing agent). This two-phase mixture was premixed at 50° C. for 2.5 min at 5000 RPM in a rotorstator mixer. The mixture was then passed through a homogenizer at 5000 psi. The resulting dispersion contained 4% of the DIAR coupler and 8% S5 by weight.

Hardened film samples were exposed, processed and evaluated as in Example 2. The percentage losses in status M red density (from a density of 1.0) for processed films after storage at −18° C. for 48 hr are given in Table III. The differences in status M red density (from a density of 1.0 in Bleach II) for samples processed using seasoned Bleach B versus samples processed using fresh Bleach II are also given in Table III.

TABLE III

| DIR Coupler | DIAR Coupler | Dr Loss % (Status M) in 48 hr @ −18° C.[1] | Dr(Bleach B) - Dr(Bleach II) at Dr = 1.0[2] |
|---|---|---|---|
| IIIa D2 | D7 | 0.16 | −0.07 |
| IIIb C1 | D7 | 0.11 | −0.04 |
| IIIc C2 | D7 | 0.12 | −0.07 |
| IIId C3 | D7 | 0.11 | −0.04 |
| IIIe D2 | C22 | 0.00 | −0.07 |
| IIIf D2 | C23 | 0.01 | −0.07 |
| IIIg D2 | C24 | 0.01 | −0.05 |
| IIIh C1 | C22 | 0.00 | −0.06 |
| IIIi C2 | C23 | 0.00 | −0.05 |
| IIIj C3 | C24 | 0.00 | −0.06 |

[1]Red density loss percentages due to dye crystallization.
[2]Red density loss due to the leuco cyan dye formation For all of the films in Table III the reductions in red density in seasoned bleach relative to fresh Bleach II are acceptable. However, film IIIa, which contains both the comparative DIR coupler and the comparative DIAR coupler, shows the largest loss in red density due to both dye crystallization and the formation of leuco cyan dye. The losses in red density due to dye crystallization are reduced for films IIIb, IIIc and IIId, which retain the comparative DIAR coupler D7 but replace the DIR coupler D2 with DIR couplers of this invention. Films IIIh, IIIj and IIIk, which contain both DIR couplers according to this invention and DIAR couplers within the scope of the definition above, show the least loss in density due to dye crystallization and leuco cyan dye formation.

DIR couplers of the type used in this Example, namely those in which $R_6$ is an alkyl group such as ethyl, are often preferred (in a multilayer system with other image-modifying couplers) over DIR couplers in which $R_6$ is phenyl in order to modulate development in the green sensitive layers without greatly inhibiting development in the red sensitive layers of multilayer color negative films.

This invention has been described in detail with particular reference to the preferred embodiments thereof, but it will be understood that variations and modifications can be effected within the spirit and scope of the invention.

We claim:

1. A photographic element comprising a support bearing (a) at least one silver halide emulsion and (b) at least one cyan dye-forming 2-phenylcarbamoyl- 1-naphthol image-modifying coupler having the structure

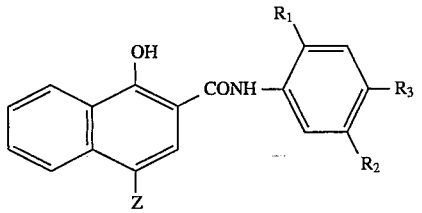

wherein:

Z is a development inhibitor moiety;

$R_1$ is selected from an alkoxy group, a phenoxy group and halogen;

$R_2$ is selected from the group consisting of an alkyl group, a phenyl group, an alkoxy group, an alkoxycarbonyl group, and a halogen; with the provisoes that when $R_2$ is a halogen, $R_1$ is selected from an alkoxy or phenoxy group, and when $R_2$ is an alkoxycarbonyl group, $R_1$ is an alkoxy group and Z is an inhibitor moiety other than a 1-phenyl-1H-tetrazole-5-thio group or a 2-carboxy-phenyl-thio group;

$R_3$ is selected from hydrogen, and an alkyl group; and $R_1$, $R_2$, and $R_3$ together contain at least 3 carbon atoms.

2. A photographic element according to claim 1 wherein $R_1$ is selected from an unsubstituted unbranched alkoxy group, and a substituted alkoxy group having less than six carbon atoms.

3. A photographic element according to claim 1 wherein $R_2$ is selected from the group consisting of an alkyl group, a phenyl group, an alkoxy group, and a halogen; with the proviso that when $R_2$ is a halogen, $R_1$ is selected from an alkoxy or a phenoxy group.

4. A photographic element according to claim 3 wherein when $R_2$ is an alkoxy group, it is unbranched and unsubstituted.

5. A photographic element according to claim 1 wherein $R_1$, $R_2$, and $R_3$, together contain at least 9 carbon atoms.

6. A photographic element according to claim 5 wherein $R_1$ is an unsubstituted, unbranched alkoxy group, $R_2$ is an unsubstituted alkyl group, and $R_3$ is hydrogen.

7. A photographic element according to claim 6 wherein $R_1$ is an n-dodecyloxy group and $R_2$ is a methyl group.

8. A photographic element according to claim 6 wherein $R_1$ is selected from an n-dodecyloxy group and an n-decyloxy group, and $R_2$ is a secondary butyl group.

9. A photographic element according to claim 5 wherein $R_1$ is an unsubstituted, unbranched alkoxy group, $R_2$ is an alkoxycarbonyl group, and $R_3$ is hydrogen.

10. A photographic element according to claim 9 wherein $R_1$ is an n-octyloxy group and $R_2$ is a 2-ethylhexoxycarbonyl group.

11. A photographic element according to claim 1 wherein said development inhibitor moiety is selected from the structures:

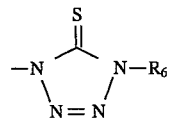

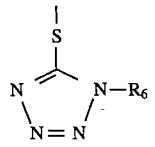

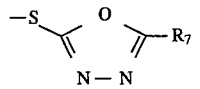

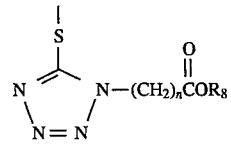

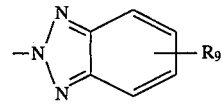

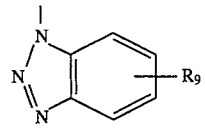

wherein:

$R_6$ is selected from the group consisting of an alkyl group containing from 1 to 8 carbon atoms, a benzyl group, and a phenyl group;

$R_7$ is $R_{12}$ or $—SR_{12}$ wherein $R_{12}$ is selected from the group consisting of an alkyl group containing from 1 to 8 carbon atoms, a benzyl group, and a phenyl group;

$R_8$ is an alkyl group containing 1 to 5 carbon atoms;

$R_9$ is selected from the group consisting of hydrogen, halogen, alkoxy, phenyl, $—COOR_{10}$ and $NHCOOR_{10}$, wherein $R_{10}$ is an alkyl group, an alkylthio group, or a phenyl group; and n is from 1 to 3.

12. A photographic element according to claim 11 wherein the development inhibitor moiety is

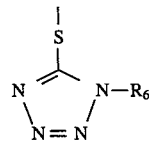

$R_6$ being selected from the group consisting of ethyl and phenyl.

13. A photographic element according to claim 1 comprising a 2-phenylcarbamoyl-1-naphthol cyan dye-forming image-modifying coupler having a structure selected from the group consisting of:
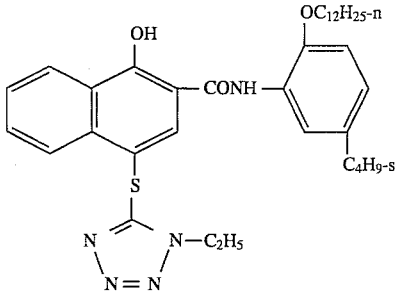
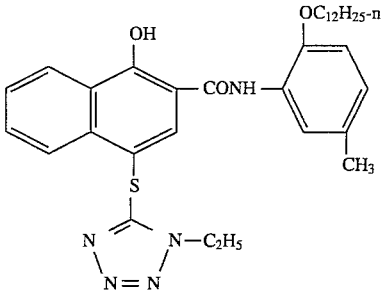
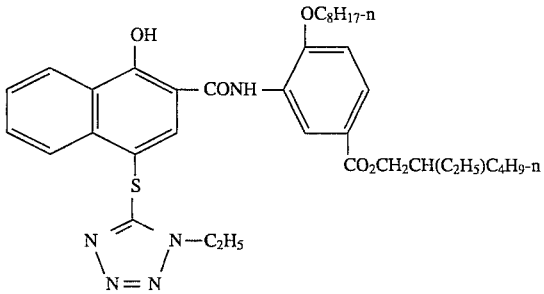
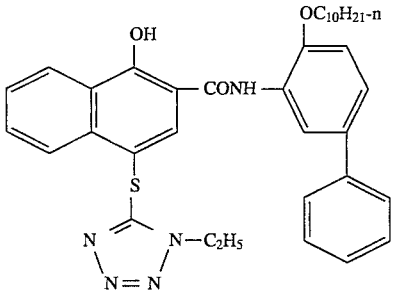
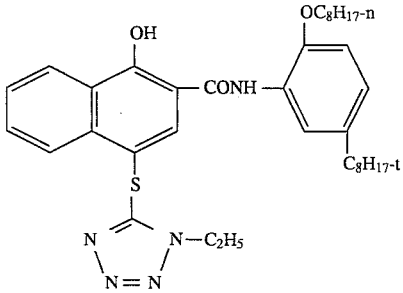
-continued
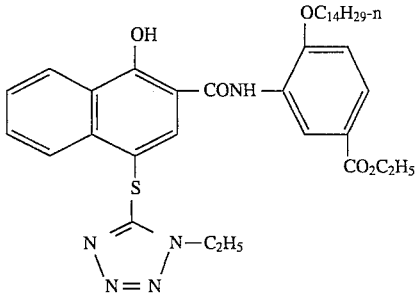
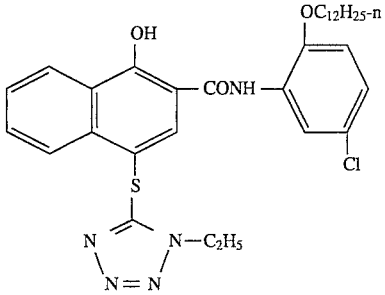
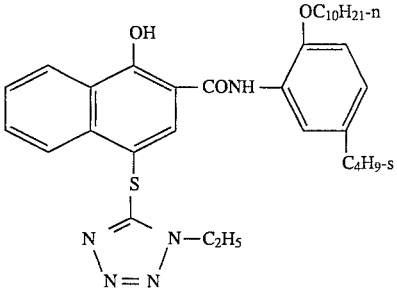
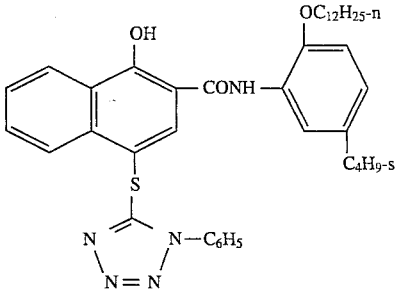
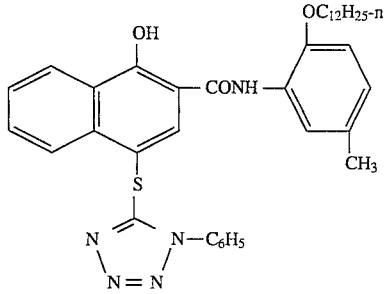

-continued

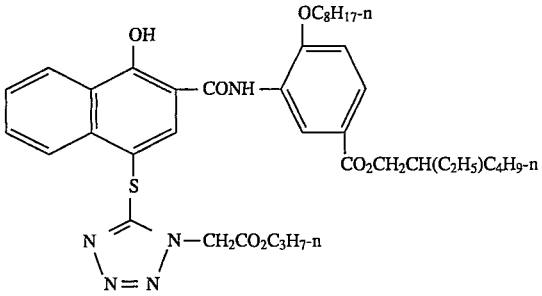

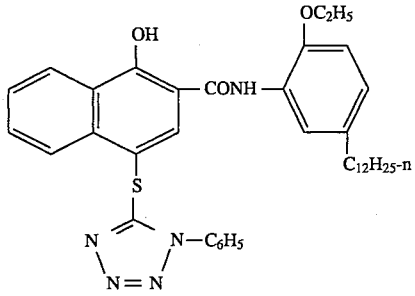

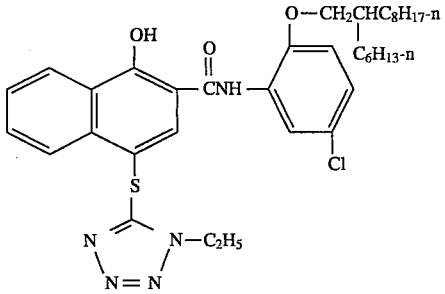

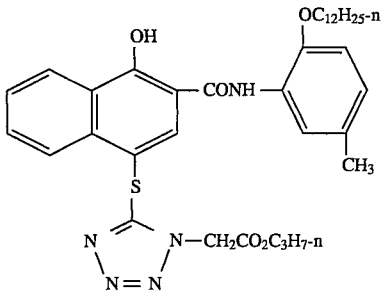

and

-continued

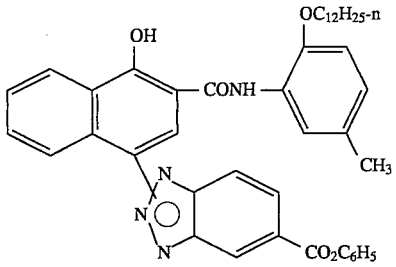

14. A photographic element according to claim 13 wherein said image-modifying coupler is selected from the group consisting of:

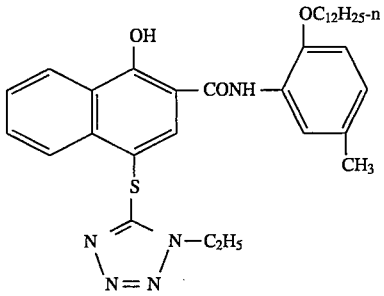

and

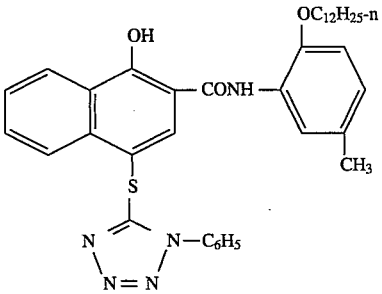

15. A photographic element according to claim 1 further comprising a cyan dye-forming 2-phenylureido- 5-carbon-amidophenol imaging coupler.

16. A photographic element according to claim 1 wherein said image-modifying coupler is present in amounts between about 0.002 and about 0.40 grams per square meter.

17. A photographic element according to claim 1 wherein said image-modifying coupler is present in amounts between about 0.01 and about 0.20 grams per square meter.

* * * * *